US009649544B2

(12) United States Patent
Fitzpatrick et al.

(10) Patent No.: US 9,649,544 B2
(45) Date of Patent: May 16, 2017

(54) BATTING TEE WITH TELESCOPING MECHANISM

(71) Applicant: EASTON BASEBALL / SOFTBALL INC., Van Nuys, CA (US)

(72) Inventors: Henry S. Fitzpatrick, Van Nuys, CA (US); Dewey Chauvin, Simi Valley, CA (US)

(73) Assignee: EASTON BASBEBALL/SOFTBALL INC., Thousand Oaks, CA (US)

( * ) Notice: Subject to any disclaimer, the term of this patent is extended or adjusted under 35 U.S.C. 154(b) by 0 days.

(21) Appl. No.: 14/664,627

(22) Filed: Mar. 20, 2015

(65) Prior Publication Data

US 2016/0271473 A1 Sep. 22, 2016

(51) Int. Cl.
*A63B 69/00* (2006.01)
*A63B 102/18* (2015.01)

(52) U.S. Cl.
CPC ..... *A63B 69/0075* (2013.01); *A63B 69/0002* (2013.01); *A63B 2069/0008* (2013.01); *A63B 2102/18* (2015.10); *A63B 2225/093* (2013.01)

(58) Field of Classification Search
CPC ..... A63B 69/00; A63B 69/02; A63B 69/08; A63B 69/10; A63B 69/71; A63B 69/93; A63B 69/0075; A63B 69/0002; A63B 2102/18; A63B 2069/0008; A63B 2225/093
USPC ..... 473/417, 422, 430, 451, 454
See application file for complete search history.

(56) References Cited

U.S. PATENT DOCUMENTS

| | | | | |
|---|---|---|---|---|
| 3,883,138 | A * | 5/1975 | Chorey | 473/417 |
| 4,993,708 | A * | 2/1991 | Prossor et al. | 473/417 |
| 6,095,572 | A * | 8/2000 | Ford et al. | 285/361 |
| 6,358,163 | B1 * | 3/2002 | Tanner | 473/417 |
| 6,682,445 | B1 | 1/2004 | Tanner et al. | |
| 7,281,998 | B2 | 10/2007 | Tanner et al. | |
| 8,246,492 | B2 | 8/2012 | Gangelhoff et al. | |
| 2006/0019773 | A1 | 1/2006 | Newman et al. | |

(Continued)

OTHER PUBLICATIONS

Tanner Tees, Tanner Tees, http://tannertees.com, exact publication date unknown, but on information and belief, at least as early as 2013 (The identified web page was last visited, and the .pdf files included herewith were created on Dec. 28, 2015).

(Continued)

*Primary Examiner* — Alvin Hunter
*Assistant Examiner* — Jeffrey Vanderveen
(74) *Attorney, Agent, or Firm* — Perkins Coie LLP

(57) ABSTRACT

A batting tee includes a base and an attachment portion attached to the base. A first rod is optionally releasably connected to the attachment portion. A second rod having an outer diameter less than an inner diameter of the first rod is positioned at least partially in the first rod. One or more O-rings are positioned on the second rod within the first rod. A collar is attached to the first rod and positioned to allow the second rod to pass through the collar while resisting passage of the O-ring out of the first rod. A rod cap is attached to an end of the second rod and positioned to resist removal of the O-ring from the second rod. A ball holder is attached to the other end of the second rod. The second rod is movable telescopically within the first rod to raise and lower the ball holder.

20 Claims, 4 Drawing Sheets

(56) References Cited

U.S. PATENT DOCUMENTS

| | | | | |
|---|---|---|---|---|
| 2007/0105662 | A1 | 5/2007 | Tanner | |
| 2011/0218058 | A1* | 9/2011 | Gangelhoff | 473/417 |
| 2011/0295999 | A1* | 12/2011 | Ferris et al. | 709/224 |
| 2012/0040780 | A1 | 2/2012 | Fournier et al. | |
| 2012/0165136 | A1* | 6/2012 | Durham et al. | 473/417 |
| 2014/0295999 | A1* | 10/2014 | Robinson | 473/417 |

OTHER PUBLICATIONS

G Tee Batting Tees, G Tee, http://thegtee.com/, exact publication date unknown, but on information and belief, at least as early as 2014 (The identified web page was last visited, and the .pdf files included herewith, were created on Dec. 28, 2015).

Promounds, The PV Tee, http://www.promounds.com/Subcategories/The-PVTee-Accessories, exact publication date unknown, but on information and belief, at least as early as 2014 (The identified web page was last visited, and the .pdf files included herewith, were created on Dec. 28, 2015).

Promounds, The PV Tee, http://www.promounds.com/PVTee-Complete-Package-Assembly, exact publication date unknown, but on information and belief, at least as early as 2014 (The identified web page was last visited, and the .pdf files included herewith, were created on Dec. 28, 2015).

USPTO, International Search Report and Written Opinion for PCT/US16/22196, 15 pgs, Apr. 14, 2016.

* cited by examiner

BATTING TEE WITH TELESCOPING MECHANISM

BACKGROUND

Batting tees are commonly used in tee-ball games and practice, and may also be used as swing aids by baseball and softball players in a practice setting. Because batters vary in height and swing styles, batting tees are typically height adjustable to meet the needs of a variety of batters. And while it is typically desirable that batting tees be portable, they are often somewhat large and unwieldy.

SUMMARY

A batting tee includes a base and an attachment portion attached to the base. A first rod is optionally releasably connected to the attachment portion. A second rod having an outer diameter less than an inner diameter of the first rod is positioned at least partially in the first rod. One or more O-rings are positioned on the second rod within the first rod. A collar is attached to the first rod and positioned to allow the second rod to pass through the collar while resisting passage of the O-ring out of the first rod. A rod cap is attached to an end of the second rod and positioned to resist removal of the O-ring from the second rod. A ball holder is attached to the other end of the second rod. The second rod is movable telescopically within the first rod to raise and lower the ball holder.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the views.

DETAILED DESCRIPTION

The present technology is directed to a batting tee with a telescoping mechanism. Various embodiments of the technology will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments. Accordingly, the technology may have other embodiments with additional elements or without several of the elements described below with reference to FIGS. 1-6.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Specific details of several embodiments of the present technology are described herein with reference to tee-ball, baseball, or softball. In other embodiments, the technology may be used to support balls in other sports, including cricket, tennis, or Wiffle® perforated plastic ball games.

The present technology provides a telescoping or collapsible batting tee that extends or collapses to accommodate different batters and to improve portability of the tee. Examples of this technology are illustrated in FIGS. 1-6.

Figure 2:
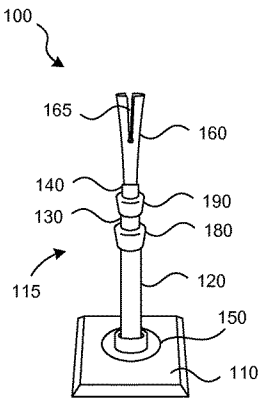
FIG. 2 is a perspective view of a batting tee in a collapsed configuration in accordance with an embodiment of the present technology.
Figure 1:
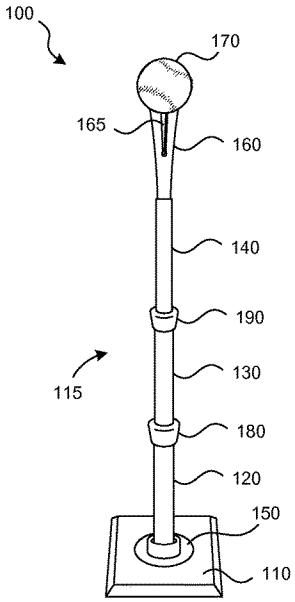
FIG. 1 is a perspective view of a batting tee in an extended configuration in accordance with an embodiment of the present technology.

Turning now to the drawings, FIGS. 1 and 2 illustrate a batting tee 100 in accordance with an embodiment of the present technology. A base portion or base 110 supports concentric telescoping rods 115 including a first or lower rod 120, a second or intermediate rod 130, and a third or upper rod 140. The base 110 may support the rods 115 by way of an attachment portion 150 that holds the lower rod 120 upright. The telescoping rods 115 support a ball holder 160, which may support a ball 170 in a position for a batter to hit. As illustrated in FIGS. 1 and 2, the rods 115 can telescopically collapse and extend so that the tee 100 has an adjustable height. In particular embodiments, the upper rod 140 may have an outer diameter of approximately 0.75 inches, the intermediate rod 130 may have an outer diameter of approximately 1 inch, and the lower rod 120 may have an outer diameter of approximately 1.5 inches. In other embodiments, the rods 115 may have other suitable diameters. The rods 115 may have various lengths suitable for accommodating users of different height ranges.

A first or lower collar 180 may be attached to the lower rod 120 and positioned to allow the intermediate rod 130 to pass therethrough with sufficient friction to maintain the rods in a desired position. In some embodiments, the collar 180 may be glued or otherwise fastened to the lower rod 120. Similarly, a second or upper collar 190 may be attached to the intermediate rod 130 and positioned to allow the upper rod 140 to pass therethrough with sufficient friction to maintain the rods in a desired position. In some embodiments, the collar 190 may be glued or fastened to the intermediate rod 130. In other embodiments, the collars 180 and 190 may be sized such that they do not provide sufficient friction to maintain the height of the tee, and they may instead work in conjunction with the O-rings described below to maintain the tee's height.

The base 110 may comprise a heavy rubber material or other material suitable for providing a solid or resilient support for the tee 100 on the ground. The telescoping rods 115 may be made of aluminum, fiberglass, carbon fiber, plastic, rubber, or other suitable structural materials. In one embodiment, the lower rod 120 and the intermediate rod 130 may be made of aluminum, while the upper rod 140 may be made of fiberglass. The attachment portion 150 may be made of aluminum, steel, plastic, or another suitable structural material.

Figure 3:
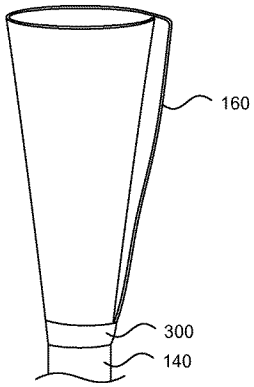
FIG. 3 is a partial perspective view of a ball holder of a batting tee in accordance with an embodiment of the present technology.
Figure 4:
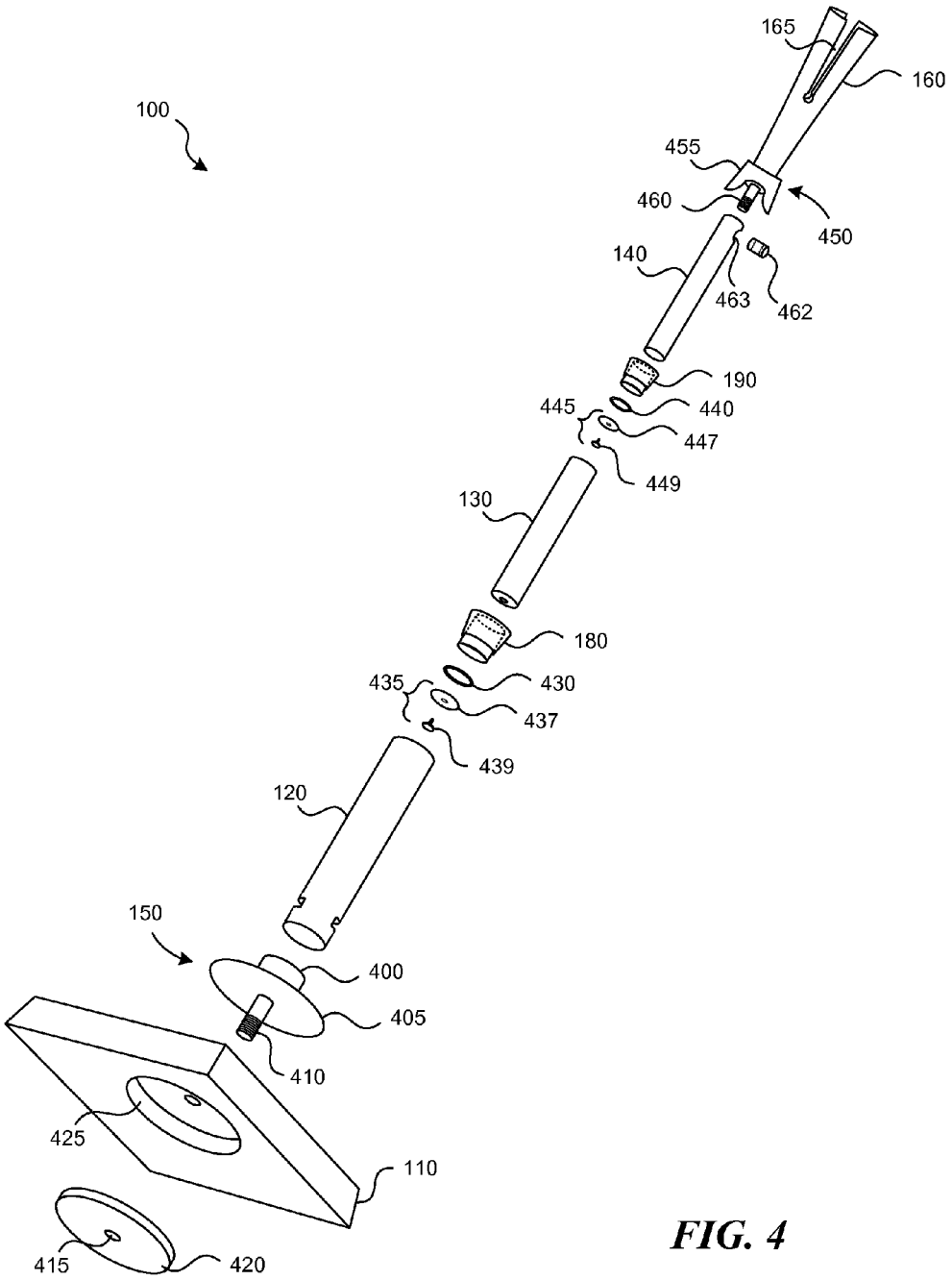
FIG. 4 is a perspective, exploded view of a batting tee in accordance with an embodiment of the present technology.

Turning now to FIG. 3, a ball holder 160 is shown mounted atop the upper rod 140. In some embodiments, the ball holder 160 may comprise a generally tubular structure such as a roll, tube, or cone made of rubber or another suitably resilient material. Optionally, as illustrated in FIG. 1, for example, the ball holder 160 may include slots, notches, or cutouts 165 extending downward from the top of the ball holder 160 to vary the flexibility of the ball holder 160. Returning to FIG. 3, the ball holder 160 may be attached to the upper rod 140 with tape or a sleeve 300, or with glue or another adhesive. With reference now to FIG. 4, in some embodiments, the ball holder 160 may be releasably attached to the upper rod 140 using a threaded bolt 460. In other embodiments, the ball holder 160 may be attached to the upper rod 140 using other suitable removable or permanent attachments.

The attachment portion 150 may include an attachment cup 400 that receives an end of the lower rod 120. The attachment portion 150 may also include an attachment plate 405 to provide stability to the attachment portion 150 on the base 110. The attachment portion 150 may further include a threaded attachment-plate extension or rod 410, which may mate directly with threads in the base 110, or with a threaded bore 415 in a lower plate 420. The lower plate 420 may be received in a corresponding recess 425 in the base 110. In some embodiments, the attachment cup 400 may be attached or mounted to the base 110 in other suitable ways.

Figure 5:
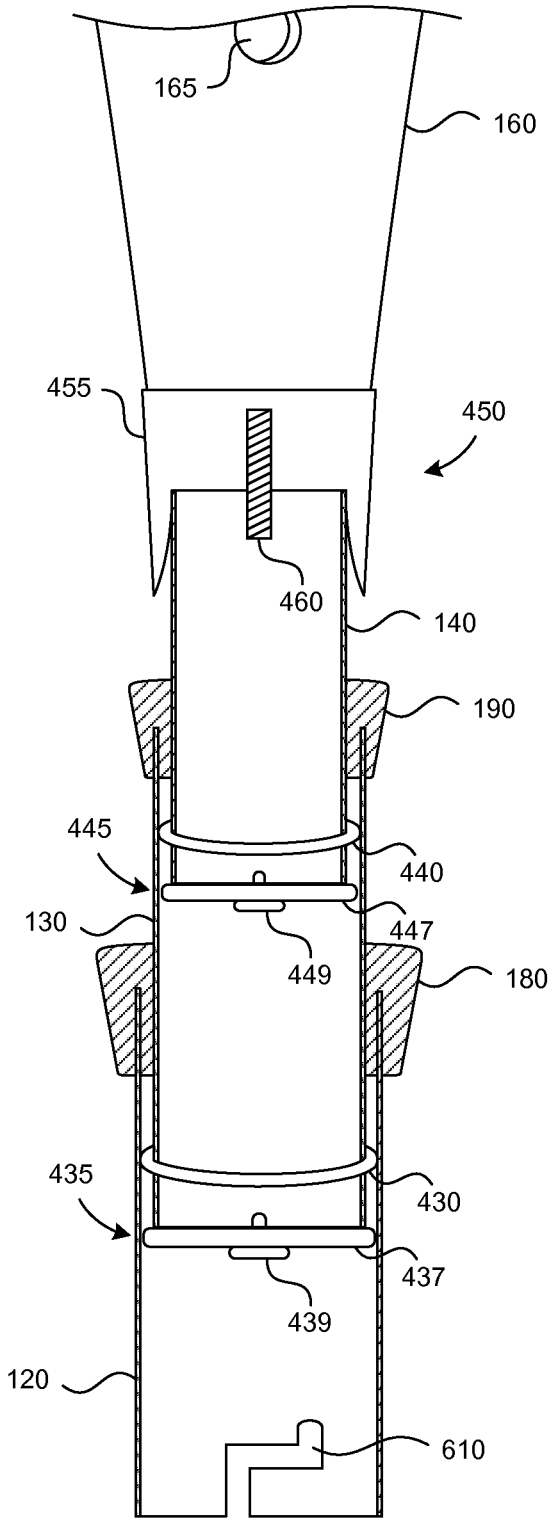
FIG. 5 is a section view of portions of a batting tee in accordance with an embodiment of the present technology.

Aspects of the telescoping rod mechanism are now described with reference to FIGS. 4 and 5. A first O-ring 430 may be positioned around a portion of the intermediate rod 130. The intermediate rod 130 with the first O-ring 430 may be telescopically received in the lower rod 120. The thickness of the O-ring 430 generally fills the gap between the lower rod 120 and the intermediate rod 130. The O-ring 430 provides friction or resistance to telescoping motion between the lower rod 120 and the intermediate rod 130 as it rolls or slides between an outer diameter of the intermediate rod 130 and an inner diameter of the lower rod 120. In some embodiments, additional O-rings may be used to modify the resistance to telescopic expansion or collapse.

To retain the O-ring 430 on the intermediate rod 130, a first rod cap 435 may be installed on the end of the intermediate rod 130 within the lower rod 120. The first rod cap 435 may be in the form of a washer 437 and a fastener or screw 439 threaded into the end of the intermediate rod 130. In another embodiment, the first rod cap 435 may be pressed or threaded directly into the intermediate rod 130, or it may be integral with the intermediate rod 130.

The washer 437, rod cap 435, or other element includes a diameter large enough to block the O-ring 430 from falling from the intermediate rod 130 into the lower rod 120. The lower collar 180 also optionally prevents the O-ring 430 from falling from the intermediate rod 130 into the lower rod 120. The lower collar 180 may be attached to the lower rod 120 with a portion of the lower collar 180 on the inside of the lower rod 120, and a portion of the lower collar 180 on the outside of the lower rod 120. The intermediate rod 130 passes through the lower collar 180 while the lower collar 180 may resist passage of the O-ring 430 out of the lower rod 120. In some embodiments, the lower collar 180 may be sized to provide sufficient friction between the lower collar 180 and the intermediate rod 130 to help maintain the tee 100 at a desired height.

The telescoping connection between the intermediate rod 130 and the upper rod 140 may be similar to the telescoping connection between the lower rod 120 and the intermediate rod 130. A second O-ring 440 may be mounted on the upper rod 140 within the intermediate rod 130 to provide friction between the upper rod 140 and the intermediate rod 130 as the upper rod 140 moves telescopically within the intermediate rod 130. A second rod cap 445 may retain the second O-ring 440 on the upper rod 140 within the intermediate rod 130. The second rod cap 445 may include a washer 447 and a fastener or screw 449 threaded onto the lower end of the upper rod 140, or it may be pressed or threaded directly into the upper rod 140, or it may be integral with the upper rod 140. The second rod cap 445 has a diameter large enough to block the second O-ring 440 from falling from the upper rod 140 into the intermediate rod 130. Similar to the lower collar 180, the upper collar 190 resists passage of the second O-ring 440 out of the intermediate rod 130 and it may also prevent the second O-ring 440 from falling from the upper rod 140. The upper collar 190 may be sized to provide sufficient friction between the upper collar 190 and the upper rod 130 to help maintain the tee 100 at a desired height. In some embodiments, the O-rings 430 and 440 may comprise silicone, rubber, or other resilient or flexible materials.

As described above with respect to FIG. 3, in some embodiments, the ball holder 160 may be mounted to the upper rod 140 using a tape or sleeve 300. Turning again to FIGS. 4 and 5, the ball holder 160 may additionally or alternatively be mounted to the upper rod 140 using a ball holder mount 450. The ball holder mount 450 may include a ball holder cap 455 installed on the upper rod 140 with a threaded rod, bolt 460, or other fastener that retains the ball holder 160. The threaded rod or bolt 460 may optionally mate with an adjoining nut or threaded portion in the upper rod 140.

In some embodiments, as shown in FIG. 4, for example, the threaded portion in the upper rod 140 may be a threaded plug 462 or other threaded receiving element pressed into an opening 463 in a side of the upper rod 140. In other embodiments, as shown in FIG. 5, for example, the threaded receiving portion may be fixed in the top end of the upper rod 140.

In some embodiments, the threaded fastener may be a screw or bolt 460 that passes through the ball holder cap 455 and the bottom of the ball holder 160 such that it is accessible for tightening by reaching into the ball holder 160 by hand or with a tool. In other embodiments, the cap 455 may be installed by pressing it onto the upper rod 140 without the need for a threaded rod, bolt 460, or other fastener.

Figure 6:
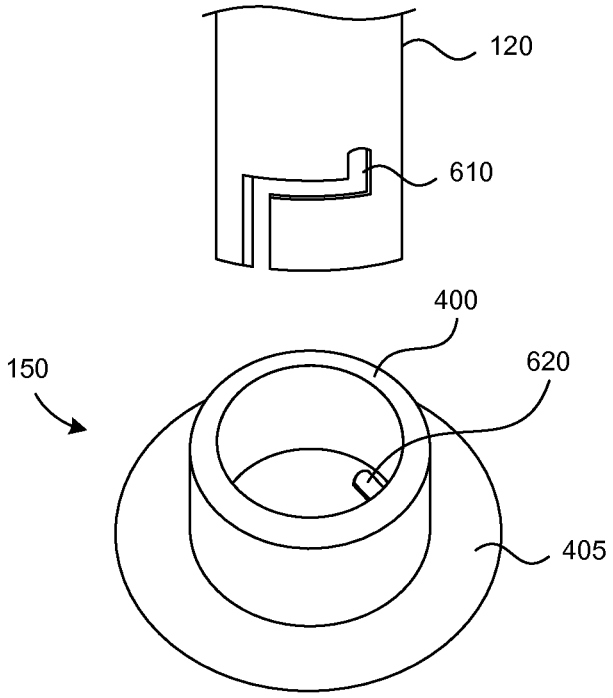
FIG. 6 is a partial perspective view of a portion of an attachment mechanism that attaches a rod of a batting tee to a base in accordance with an embodiment of the present technology.

Turning to FIG. 6, the lower rod 120 may have a groove 610 configured to receive a lug 620 extending from an interior surface of the attachment cup 400. When the lower rod 120 is positioned in the attachment cup 400, the lug 620 first slides through a vertical portion of the groove 610. The lower rod 120 may then be locked into the attachment cup 400 by rotating the lower rod 120 so that the lug 620 slides through a horizontal portion of the groove 610. In this manner, the lower rod 120 may be releasably locked into the attachment portion 150. Accordingly, the rods 115 may be readily attached to, and removed from, the base 110.

From the foregoing, it will be appreciated that specific embodiments of the disclosed technology have been described for purposes of illustration, but that various modifications may be made without deviating from the technology, and elements of certain embodiments may be interchanged with those of other embodiments. For example, in some embodiments, only two telescoping rods 115 may be used, and in other embodiments, more than three telescoping rods 115 may be used. In other embodiments, the base attachment portion 150 may be integral with the base 110.

Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology may encompass other embodiments not expressly shown or described herein, and the invention is not limited except as by the appended claims.

What is claimed is:

1. A batting tee, comprising:

a base;

an attachment portion attached to the base;

a first rod having a first end and a second end, the first end releasably connected to the attachment portion;

a second rod having a third end and a fourth end, the second rod having an outer diameter less than an inner diameter of the first rod, with the third end positioned at least partially in the second end of the first rod;

at least one O-ring positioned on the second rod within the first rod;

a collar attached to the second end of the first rod and positioned to allow the second rod to pass through the collar, the collar further being positioned to resist passage of the at least one O-ring out of the first rod;

a rod cap attached to the third end of the second rod, at least a portion of the rod cap extending into a gap between the first rod and the second rod to resist removal of the at least one O-ring from the second rod when the rod cap is positioned within the first rod; and a ball holder attached to the fourth end of the second rod;

wherein the second rod is positioned to move telescopically within the first rod to raise and lower the ball holder.

2. The batting tee of claim 1 wherein the attachment portion comprises an attachment cup positioned to receive the first end of the first rod.

3. The batting tee of claim 2 wherein the attachment cup comprises a lug extending from an interior surface of the attachment cup, and wherein the first end of the first rod comprises a groove positioned to receive the lug when the first end is received in the attachment cup.

4. The batting tee of claim 1 further comprising a plate having a threaded bore, wherein the base comprises a recess that receives the plate, and wherein the attachment portion comprises a rod threaded into the bore.

5. The batting tee of claim 1 further comprising a threaded receiving element positioned in the fourth end of the second rod, wherein the ball holder is attachable to the second rod via a fastener that threads into the receiving element.

6. The batting tee of claim 1 wherein the rod cap comprises a washer and a fastener, the washer having an outer diameter larger than the outer diameter of the second rod and larger than an inner diameter of the at least one O-ring, the fastener positioned to retain the washer to the third end of the second rod.

7. The batting tee of claim 1 wherein at least one of the first and second rods comprises fiberglass.

8. The batting tee of claim 1 wherein at least one of the first and second rods comprises aluminum.

9. A batting tee, comprising:

a ball holder;

a base; and at least two telescoping rods, wherein among any two adjacent telescoping rods, a first rod is telescopically received within a second rod such that a gap is formed between the first rod and the second rod, wherein one of the telescoping rods is a lower rod attached to the base, and another of the telescoping rods is an upper rod attached to the ball holder;

a collar attached to an end portion of the second rod;

a rod cap attached to an end portion of the first rod, at least a portion of the rod cap extending beyond an outer diameter of the first rod into the gap; and an O-ring positioned around the first rod between the collar and the rod cap in the gap, wherein the O-ring is configured to move within the gap, and wherein the collar and the rod cap are positioned to retain the O-ring in the gap.

10. The batting tee of claim 9 wherein the at least two telescoping rods include at least three telescoping rods.

11. The batting tee of claim 10 wherein two of the at least three telescoping rods comprise aluminum, and one of the at least three telescoping rods comprises fiberglass.

12. The batting tee of claim 9 wherein among any two adjacent telescoping rods, more than one O-ring is positioned around the first rod between the collar and the rod cap within the gap.

13. The batting tee of claim 9, further comprising an attachment portion attached to the base, wherein the attachment portion comprises an attachment cup, and the lower rod is received in the attachment cup.

14. The batting tee of claim 13 wherein the attachment cup comprises a lug extending from an interior surface of the attachment cup, and wherein the lower rod comprises a groove positioned to receive the lug.

15. The batting tee of claim 9 further comprising a ball holder cap on the upper rod that retains the ball holder.

16. The batting tee of claim 9 wherein the ball holder comprises a generally tubular roll of rubber including at least one cutout.

17. An adjustable batting tee, comprising:

a base;

a first rod attached to the base;

a second rod telescopically received in the first rod;

a first collar positioned on the first rod and configured to permit the second rod to move therethrough, the first collar having a first collar inner diameter smaller than an inner diameter of the first rod;

a first O-ring positioned on the second rod within the first rod;

a first rod cap positioned on the second rod within the first rod and having a first rod cap diameter greater than an outer diameter of the second rod;

a third rod telescopically received in the second rod;

a second collar positioned on the second rod and configured to permit the third rod to move therethrough, the second collar having a second collar inner diameter smaller than an inner diameter of the second rod;

a second O-ring positioned on the third rod within the second rod;

a second rod cap positioned on the third rod within the second rod and having a second rod cap diameter greater than an outer diameter of the third rod; and a ball holder attached to the third rod;

wherein the first, second, and third rods are configured to telescopically extend and retract;

and wherein the first rod cap resists removal of the first O-ring from the second rod when the first rod cap is positioned within the first rod or wherein the second rod cap resists removal of the second O-ring from the third rod when the second rod cap is positioned within the second rod.

18. The adjustable batting tee of claim 17 wherein the first rod is attached to the base by an attachment portion, the attachment portion comprising an attachment cup configured to receive an end of the first rod proximate to the base.

19. The adjustable batting tee of claim 18 wherein the attachment cup comprises a lug, and the end of the first rod comprises a grooved portion that slides over the lug.

20. The adjustable batting tee of claim 17, further comprising a third O-ring positioned on the second rod within the first rod or positioned on the third rod within the second rod.

* * * * *